United States Patent [19]

Masumoto et al.

[11] Patent Number: 4,909,867

[45] Date of Patent: Mar. 20, 1990

[54] HIGH STRENGTH, HEAT RESISTANT ALUMINUM ALLOYS

[75] Inventors: Tsuyoshi Masumoto, 3-8-22, Kamisugi, Sendai-shi, Miyagi; Akihisa Inoue, Sendai; Katsumasa Odera, Kurobe; Masahiro Oguchi, Okaya, all of Japan

[73] Assignees: Yoshida Kogyo K. K.; Tsuyoshi Masumoto, both of Japan; a part interest

[21] Appl. No.: 243,501

[22] Filed: Sep. 12, 1988

[30] Foreign Application Priority Data

Nov. 10, 1987 [JP] Japan ..... 62-282132

[51] Int. Cl.[4] ..... C22C 21/00

[52] U.S. Cl. ..... 148/403; 420/538; 420/550

[58] Field of Search ..... 148/403, 415, 416, 437, 148/438; 420/538, 550

[56] References Cited

U.S. PATENT DOCUMENTS 4,710,246 12/1987 Le Caer et al. ..... 148/403

*Primary Examiner*—R. Dean

*Attorney, Agent, or Firm*—Hill, Van Santen, Steadman & Simpson

[57] ABSTRACT

The present invention provides high-strength and heat resistant aluminum alloys having a composition represented by the general formula $Al_aM_bLa_c$ (wherein M is at least one metal element selected from the group consisting of Fe, Co, Ni, Cu, Mn and Mo; and a, b and c are atomic percentages falling within the following ranges:

$$65 \leqq a \leqq 93,\ 4 \leqq b \leqq 25 \text{ and } 3 \leqq c \leqq 15),$$

the aluminum alloys containing at least 50% by volume of amorphous phase. The aluminum alloys are especially useful as high strength and high heat resistant materials in various applications and, since the aluminum alloys specified above exhibit a superplasticity in the vicinity of their crystallization temperature, they can be readily worked into bulk forms by extrusion, press working or hot forging in the vicinity of the crystallization temperature.

1 Claim, 1 Drawing Sheet

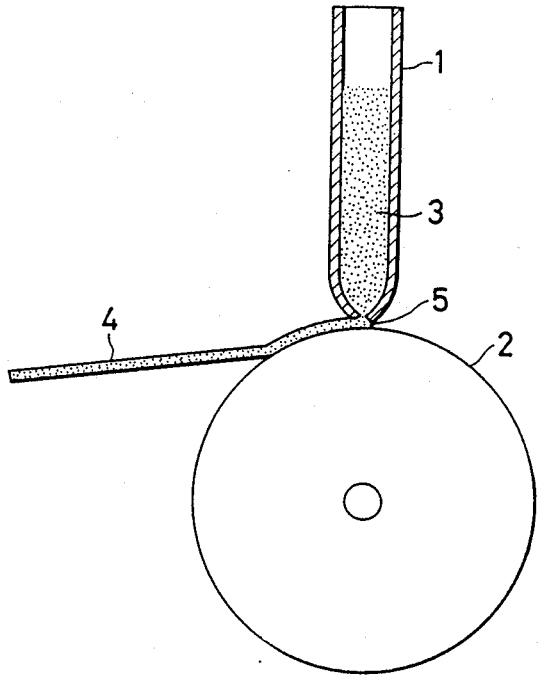
1
3
5
4
2

HIGH STRENGTH, HEAT RESISTANT ALUMINUM ALLOYS

BACKGROUND OF THE INVENTION

1. Field of the Invention

The present invention relates to aluminum alloys having a desired combination of properties of high hardness, high strength, high wear-resistance and superior heat-resistance.

2. Description of the Prior Art

As conventional aluminum alloys, there have been known various types of aluminum-based alloys such as Al-Cu, Al-Si, Al-Mg, Al-Cu-Si, Al-Zn-Mg alloys, etc. These aluminum alloys have been extensively used in a variety of applications, such as structural materials for aircrafts, cars, ships or the like; structural materials used in external portions of buildings, sash, roof, etc.; marine apparatus materials, nuclear reactor materials, etc., according to their properties.

In general, the aluminum alloys heretofore known have a low hardness and a low heat resistance. In recent years, attempts have been made to achieve a fine structure by rapidly solidifying aluminum alloys and thereby improve the mechanical properties, such as strength, and chemical properties, such as corrosion resistance, of tee resulting aluminum alloys. But none of the rapid solidified aluminum alloys known heretofore has been satisfactory in the properties, especially with regard to strength and heat resistance.

SUMMARY OF THE INVENTION

In view of the foregoing, it is an object of the present invention to provide novel aluminum alloys which have a good combination of properties of high hardness, high strength and outstanding corrosion resistance and which can be successfully subjected to operations, such as extrusion, press working or a high degree of bending, at relatively low cost.

According to the present invention, there are provided high-strength, heat resistant aluminum alloys having a composition represented by the general formula:

$$Al_aM_bLa_c$$

wherein:

M is at least one metal element selected from the group consisting of Fe, Co, Ni, Cu, Mn and Mo; and a, b and c are atomic percentages falling within the following ranges:

$$65 \leqq a \leqq 93,\ 4 \leqq b \leqq 25 \text{ and } 3 \leqq c \leqq 15,$$

the aluminum alloys containing at least 50% by volume of amorphous phase.

The aluminum alloys of the present invention are very useful as high-hardness material, high-strength material, high electrical-resistant material, wear-resistant material and brazing material. Further, since the aluminum alloys exhibit a superplasticity phenomenon at temperatures near the crystallization temperatures thereof, they can be subjected to extrusion, pressing and other processings. The aluminum alloys such processed have good utility as high strength and high heat-resistant materials in a variety of applications because of the high hardness and high tensile strength.

BRIEF DESCRIPTION OF THE DRAWING

The single FIGURE is a schematic view of a single roller-melting apparatus employed to prepare ribbons from the alloys of the present invention by a rapid solidification process.

DETAILED DESCRIPTION OF THE PREFERRED EMBODIMENTS

The aluminum alloys of the present invention can be obtained by rapidly solidifying melt of the alloy having the composition as specified above by means of a liquid quenching process. The liquid quenching technique is a method for rapidly cooling molten alloy and, particularly, single roller melt-spinning technique, twin roller melt-spinning technique and in- rotating-water melt-spinning technique, etc. are mentioned as effective examples of such a technique. In these processes, the cooling rate of about $10^4$ to $10^6$ K/sec can be achieved. In order to produce ribbon materials by the single roller melt-spinning technique or twin roller melt-spinning technique, molten alloy is ejected through a nozzle to a roll of, for example, copper or steel, with a diameter of about 30–3000 mm, which is rotating at a constant rate of about 300–10000 rpm. In these techniques, various ribbon materials with a width of about 1–300 mm and a thickness of about 5–500 μm can be readily obtained. Alternatively, in order to produce wire materials by the in-rotating-water melt-spinning technique, a molten jet of molten alloy is directed under application of the back pressure of argon gas, through a nozzle into a liquid refrigerant layer with a depth of about 1 to 10 cm which is formed by centrifugal force in a drum rotating at a rate of about 50 to 500 rpm. In such a manner, wire-like materials can be readily obtained. In this technique, the angle between the molten alloy ejecting from the nozzle and the liquid refrigerant surface is preferably in the range of about 60° to 90° and the ratio of the velocity of the ejected molten alloy to the velocity of the liquid refrigerant surface is preferably in the range of about 0.7 to 0.9.

Besides the above process, the alloy of the present invention can be also obtained in the form of thin film by a sputtering process. Further, rapidly solidified powder of the alloy composition of the present invention can be obtained by various atomizing processes, for example, high pressure gas atomizing process or spray process.

Whether the rapidly solidified alloys thus obtained above are amorphous or not can be known by checking the presence of the characteristic halo patterns of an amorphous structure using an ordinary X-ray diffraction method. The amorphous structure is transformed into a crystalline structure by heating to a certain temperature (i.e., crystallization temperature) or higher temperatures.

In the aluminum alloys of the present invention specified by the above general formula, a is limited to the range of 65 to 93 atomic % and b is limited to the range of 4 to 25 atomic %. The reason for such limitations is that when a and b stray from the respective ranges, the intended alloys having at least 50 volume % of amorphous region can not be obtained by the industrial cooling techniques using the above-mentioned liquid quenching, etc. The element M is selected from the group consisting of Fe, Co, Ni, Cu, Mn and Mo and has an effect in improving the capability to form an amorphous structure. Further, the element M, in combination of La, not only provide significant improvements in the hardness and strength but also considerably increases the crystallization temperature, thereby resulting in a significantly improved heat resistance.

The reason why c is limited to the range of 3 to 15 atomic % is that when La is added in this range, considerably improved hardness and heat resistance can be achieved. When c is beyond 15 atomic %, it is impossible to obtain the alloys having at least 50 volume % of amorphous phase.

Further, since the aluminum alloys of the present invention exhibit superplasticity in the vicinity of their crystallization temperatures (crystallization temperatures±100° C.), they can be readily subjected to extrusion, press working, hot forging, etc. Therefore, the aluminum alloys of the present invention obtained in the form of ribbon, wire, sheet or powder can be successfully processed into bulk by extrusion, pressing, hot forging, etc., at the temperature range of their crystallization temperatures±100° C. Further, since the aluminum alloys of the present invention have a high degree of toughness, some of them can be bent by 180° without fracture.

Now, the advantageous features of the aluminum alloys of the present invention will be described with reference to the following examples.

EXAMPLE 1

Molten alloy 3 having a predetermined alloy composition was prepared b high-frequency melting process and was charged into a quartz tube 1 having a small opening 5 with a diameter of 0.5 mm at the tip thereof as shown in the FIGURE. After heating and melting the alloy 3, the quartz tube 1 was disposed right above a copper roll 2, 20 cm in diameter. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 is rapidly solidified and an alloy ribbon 4 was obtained.

According to the production conditions as described above, 20 different kinds of alloys having the compositions given in Table were obtained in a ribbon form, 1 mm in width and 20 μm in thickness, and were subjected to X-ray diffraction analysis. In all of the alloys, halo patterns characteristics of amorphous metal were confirmed.

Further, crystaliization temperature (Tx) and the hardness (Hv) were measured for each test specimen of the alloy ribbons and there were obtained the results as shown in Table. The hardness is indicated by values (DPN) measured using a Vickers microhardness tester under load of 25 g. The crystallization temperature ($T_x$) is a starting temperature (K) of the first exothermic peak on the differential scanning calorimetric curve which was conducted for each test specimen at a heating rate of 40 K/min. In the column of "Structure", characters "a" and "c" represent an amorphous structure and a crystalline structure, respectively.

TABLE

| | Composition (by at. %) | Structure | Toughness | TX (K) | Hv (DPN) |
|---|---|---|---|---|---|
| 1. | $Al_{75}Fe_{20}La_5$ | a | brittle | 721 | 203 |
| 2. | $Al_{75}Fe_{15}La_{10}$ | a | brittle | 683 | 182 |
| 3. | $Al_{80}Fe_{15}La_5$ | a + c | brittle | 654 | 341 |
| 4. | $Al_{80}Fe_{10}La_{10}$ | a | brittle | 636 | 268 |
| 5. | $Al_{85}Fe_{7.5}La_{7.5}$ | a | tough | 626 | 256 |
| 6. | $Al_{70}Co_{20}La_{10}$ | a + c | brittle | 793 | 414 |
| 7. | $Al_{72}Co_{18}La_{10}$ | a | brittle | 721 | 531 |
| 8. | $Al_{75}Co_{15}La_{10}$ | a | brittle | 672 | 519 |
| 9. | $Al_{85}Co_{7.5}La_{7.5}$ | a | tough | 605 | 505 |
| 10. | $Al_{75}Ni_{20}La_5$ | a | brittle | 718 | 480 |
| 11. | $Al_{80}Ni_{10}La_{10}$ | a | tough | 628 | 465 |
| 12. | $Al_{85}Ni_{7.5}La_{7.5}$ | a | tough | 559 | 421 |
| 13. | $Al_{88}Ni_9La_3$ | a | tough | 439 | 393 |
| 14. | $Al_{90}Ni_5La_5$ | a + c | tough | 523 | 464 |
| 15. | $Al_{85}Cu_{7.5}La_{7.5}$ | a | tough | 497 | 442 |
| 16. | $Al_{85}Mn_{7.5}La_{7.5}$ | a | tough | 615 | 511 |
| 17. | $Al_{85}Mo_{7.5}La_{7.5}$ | a | tough | 511 | 493 |
| 18. | $Al_{80}Cu_5Ni_5La_{10}$ | a | tough | 535 | 472 |
| 19. | $Al_{80}Ni_5Mo_{7.5}La_{7.5}$ | a | tough | 570 | 450 |
| 20. | $Al_{80}Fe_5Ni_5La_{10}$ | a | tough | 585 | 380 |

As shown in Table, the aluminum alloys of the present invention have a very high hardness of about 200 to 530 DPN in comparison with the hardness of the order of 50 to 100 DPN of known aluminum alloys. Further, it is noteworthy that the aluminum alloys of the present invention have a high crystallization temperature of the order of about 440° K. or higher, thereby resulting in a high heat-resistance.

What is claimed is:

1. A high-strength, heat resistant aluminum alloy consisting essentially of a composition represented by the general formula:

$$Al_aM_bLa_c$$

wherein:

M is at least one metal element selected from the group consisting of Fe, Co, Ni, Cu, Mn and Mo; and a, b and c are atomic percentages falling within the following ranges:

$$65 \leqq a \leqq 93,\ 4 \leqq b \leqq 25 \text{ and } 3 \leqq c \leqq 15,$$

said aluminum alloy containing at least 50% by volume of amorphous phase.

* * * * *